United States Patent [19]

Hogue et al.

[11] 4,224,880

[45] Sep. 30, 1980

[54] RAILWAY CAR NAILABLE FLOOR

[75] Inventors: J. W. Hogue, Bessemer; B. Dean Horner; Dudley Foster, both of Birmingham, all of Ala.

[73] Assignee: Pullman Incorporated, Chicago, Ill.

[21] Appl. No.: 914,114

[22] Filed: Jun. 9, 1978

[51] Int. Cl.[2] ..... B61D 17/10; E04B 5/10

[52] U.S. Cl. ..... 105/422; 52/58; 52/377; 105/370; B61D/49/00

[58] Field of Search ..... 105/422, 370; 52/58, 52/377

[56] References Cited

U.S. PATENT DOCUMENTS

| | | | |
|---|---|---|---|
| 2,667,243 | 1/1954 | Fenske | 105/422 X |
| 2,907,417 | 10/1959 | Doerr | 105/422 X |
| 3,088,420 | 5/1963 | Faverty et al. | 105/422 |
| 3,102,613 | 9/1963 | Johnston | 105/422 X |
| 3,187,853 | 6/1965 | Glaser et al. | 105/422 X |
| 3,420,192 | 1/1969 | Ellis | 105/422 |
| 4,010,587 | 3/1977 | Larsen | 105/422 X |

*Primary Examiner*—John J. Love
*Assistant Examiner*—Howard Beltran
*Attorney, Agent, or Firm*—Richard J. Myers; Stephen D. Geimer

[57] ABSTRACT

A nailable floor panel structure including a plurality of generally inverted-channel shaped parallel floor planks with depending flanges disposedly downwardly in generally abutting relation, and generally linear end caps affixed and rigidly interconnecting the respective ends of the panel planks. Each end cap includes longitudinally spaced, laterally offset portions corresponding to the floor plank junctures, and cut-out portions at the ends of the cap conforming in shape to the depending flanges of the channel-shaped floor planks. The design provides enhanced structural integrity of the finished floor panel and facilitates modular fabrication of the finished panel.

4 Claims, 5 Drawing Figures

RAILWAY CAR NAILABLE FLOOR

BACKGROUND OF THE INVENTION

1. Field of the Invention

This invention pertains to floor construction for vehicles and particularly to a floor for railway freight cars.

2. Description of the Prior Art

The prior art discloses various designs of floor constructions capable of receiving freight anchoring nails.

U.S. Pat. Nos. 4,010,587 and 2,667,243 disclose various types of shaped groove structures in a nailable steel floor construction for receiving nails, while U.S. Pat. No. 2,907,417 shows structural floor clips engaging planks of a nailable steel floor.

U.S. Pat. No. 3,102,613 illustrates a sealed nailing groove formed by cooperating foot portions of metal strips. In U.S. Pat. No. 3,088,420, a nailable metal floor is disclosed including Z-section supports. None of these patents, however, illustrate the improved end cap design of the present invention which provides enhanced structural integrity of the floor panel and facilitates fabrication thereof.

SUMMARY OF THE INVENTION

The present invention is an improved design for a nailable floor panel for a vehicle comprised of a plurality of parallel floor planks which includes an end cap conformingly fit to each end of the panel. The floor may be constructed of appropriate metallic or non-metallic materials. The floor planks are of a generally inverted-channel shape, with the flanges disposed downwardly so that the upwardly disposed web portions of the channels are disposed flush to provide a smooth surface floor throughout the interior area of the vehicle. The depending side flanges of adjacent planks are disposed in generally abutting complemental opposed relation, with sufficient space therebetween to provide a nailing groove at each juncture of adjacent planks. A mastic cement or sealer may be disposed within the nailing grooves to protect the interior of the vehicle from the elements, dirt, and debris, yet still allow easy insertion of anchoring nails within the grooves.

The end cap or connecting strap of the present invention is of a generally linear configuration, including longitudinally spaced, laterally offset portions corresponding to the junctures of adjacent floor planks. This design allows the end cap to be fitted flush with the webs of the channel-shaped planks, while conformingly fitting to the junctures of the complemental side flanges of adjacent planks. Fabrication is facilitated by providing better welding condition and if the panel is constructed of metallic materials, helping to control overall size of the finished floor panel, resulting in modularization of finished panels. The modular nature of the floor panel structure permits fabrication of the panel prior to installation within a freight vehicle. The end cap design also provides improved support at the ends of the floor panels, enhancing structural integrity of the vehicle floor and reducing servicing. In addition, the conforming fit of the end cap relative to the floor planks provides improved light sealing of the finished panel, further ensuring proper protection of the interior of the vehicle from the elements.

DESCRIPTION OF THE PREFERRED EMBODIMENT

Figure 1:
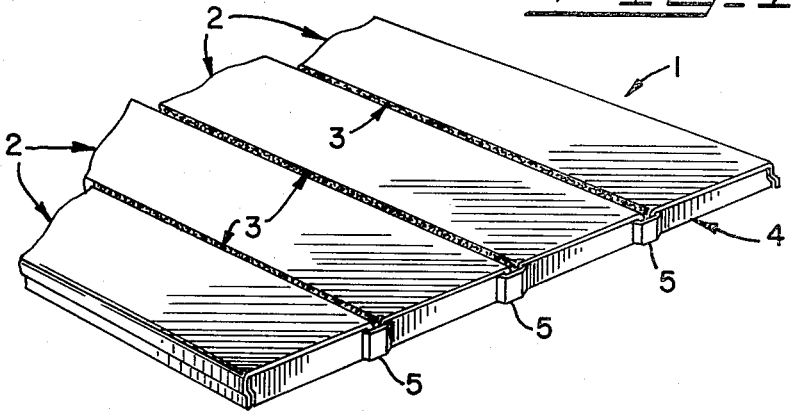
FIG. 1 shows a perspective view of a nailable vehicle floor panel of metal construction.

FIG. 1 shows a perspective view of a nailable floor panel of a vehicle generally designated at 1. The panel comprises a plurality of parallel floor planks 2 with sufficient space therebetween to provide nailing grooves 3 at each juncture of adjacent planks. An end cap or connecting strap 4 is affixed to the ends of the floor planks 2, and includes longitudinally spaced, laterally offset portions 5 which conformingly fit over the junctures of adjacent floor planks 2, facilitating modularized fabrication and enhancing structural integrity of the finished panel 1.

Figure 2:
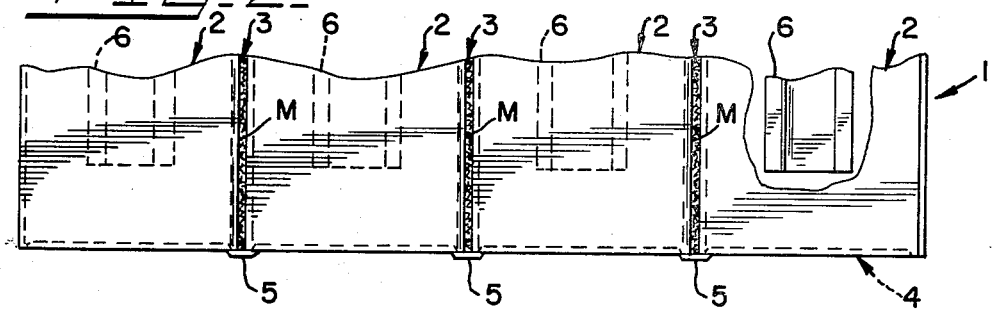
FIG. 2 shows a plan view in partial cutaway of the floor panel shown in FIG. 1.

FIG. 2 shows a partially cutaway plan view of the floor panel 1. Each floor plank 2 is supported upon the underframe of the vehicle (not shown) by means of an intermediate support member or stringer 6 running longitudinally of the floor plank 2. Support member 6 is typically spot welded or affixed in another suitable fashion to the underside of plank 2. Referring to FIG. 2, the relative positioning of end cap 4 can be seen. The relative positioning of laterally offset portions 5 to nailing grooves 3 is also shown. Nailing grooves 3 may contain a mastic cement M, disposed within the grooves 3 in order to help seal the interior of the vehicle from the elements.

Figure 3:
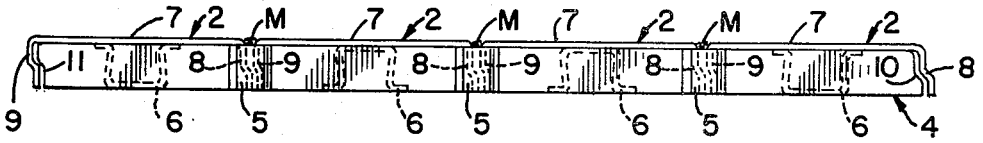
FIG. 3 shows an end view of the floor panel shown in FIG. 1.

As best shown in FIG. 3, each floor plank 2 is generally channel-shaped, with web portions 7 disposed flush to provide a smooth surface floor throughout the interior area of the vehicle. Depending side flanges 8 and 9 of adjacent planks 2 are disposed in complemental opposed relation, with sufficient space between them to provide a nailing groove 3 at the juncture of adjacent planks 2. The articulated, complemental shape of side flanges 8 and 9 is designed to provide a nailing groove 3 capable of anchoring nails inserted therein, but it is understood that the applicability of end cap 4 is not limited to a nailable floor panel having this particular nailing groove configuration.

Figure 4:
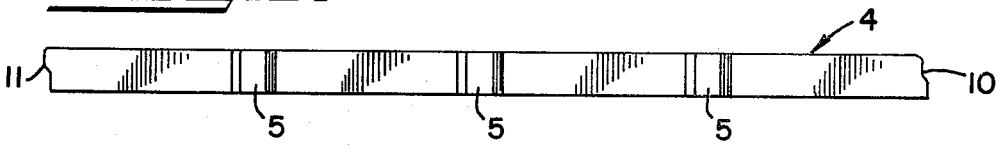
FIG. 4 shows in elevation the end cap design of the present invention.

As shown in both FIGS. 3 and 4, the ends of end cap 4 include articulated portions 10 and 11, which correspond in shape to depending side flanges 8 and 9, respectively. The articulated shape of portions 10 and 11 permit end cap 4 to better support the ends of floor planks 2, and enhances the over-all structural integrity of the floor panel. Modular fabrication of finished floor panels is thereby achieved, permitting fabrication of the panel prior to installation within a freight vehicle. Portions 10 and 11 of end cap 4 and their respective side flanges 8 and 9 may be, but are not necessarily, permanently affixed to one another.

Figure 5:
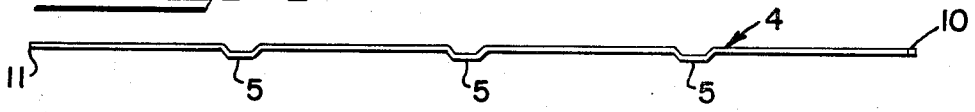
FIG. 5 shows a plan view of the end cap shown in FIG. 4.

FIG. 5 best shows the general configuration of end cap 4, illustrating the regular spacing of laterally offset portions 5.

It should be noted that the particular dimensions of the offset portions 5, as well as the interval at which they are fabricated into end cap 4 depends upon the width of floor planks 2, the thickness of side flanges 8 and 9, and the overall dimension of nailing grooves 3. Offset portions 5 are of sufficient size to be affixed in overlapping relation over the portions, of any two adjacent flanges 8 and 9, which are innermost to the floor plank 2 of which they are a portion. This is best illustrated in FIGS. 2 and 3. Web portions 7 of planks 2 are affixed to end cap 4 in flush relation as best illustrated in FIG. 2.

The present invention may be adapted to floor panels of any dimension, with the number of offset portions 5 being one less than the number of planks 2 in the panel.

What is claimed is:

1. In a freight vehicle having an underframe, a nailable metal floor structure mounted on said underframe comprising:

a plurality of metal planks disposed in side by side generally parallel relation with one end of each plank in general alignment with a common plane, each plank comprising a generally inverted channel-shaped section having a horizontal web forming the surface of the floor and having flanges depending from the edges of said web so that the adjacent flanges of contiguous planks are complemental to each other thereby providing nailing grooves between each adjacent pair of said planks, and a generally linear upright end cap rigidly affixed across the ends of said planks generally adjacent to said plane and in flush relation with the underside of said webs of said metal planks thereby enhancing vertical support of said webs, said end cap including longitudinally spaced, laterally offset portions comformingly fitted to adjacent flanges of contiguous planks.

2. The nailable metal floor structure in accordance with claim 1, said end cap having end portions complemental to the shape of two outermost depending flanges of said floor structure.

3. A modular nailable floor panel structure for a freight vehicle comprising:

a plurality of generally channel-shaped planks, each plank having a web and a pair of flanges depending therefrom and said planks being disposed in spaced generally parallel relation with the respective ends of each plank in general alignment with respective common planes, said webs adapted to form a portion of the vehicle floor surface and the adjacent flanges of said contiguous planks defining nailing grooves therebetween, connector straps spanning and rigidly interconnecting the respective ends of said adjacent planks, each strap being generally adjacent to one of said planes, said straps being in generally flush relation with the lower side of said webs of said planks thereby enhancing vertical support of said modular nailable floor panel structure, and said connector straps including a plurality of longitudinally spaced outwardly offset portions bridging adjacent flanges of said contiguous planks.

4. The modular nailable floor panel structure in accordance with claim 3, said connector straps having end portions complemental to the shape of two outermost depending flanges of said panel structure.

* * * * *